United States Patent [19]

Draffen et al.

[11] Patent Number: 5,005,983

[45] Date of Patent: Apr. 9, 1991

[54] PLATE BLENDER

[75] Inventors: Dale Draffen, Paducah; William E. Dunning, Eddyville; Larry D. McGregor, Benton; Donald L. Walker, Paducah, all of Ky.; Harold R. Sisk, Deatsville, Ala.

[73] Assignee: Apex Engineering Inc., Calvert City, Ky.

[21] Appl. No.: 299,445

[22] Filed: Jan. 23, 1989

[51] Int. Cl.[5] ..... B01F 5/00

[52] U.S. Cl. ..... 366/340; 366/341

[58] Field of Search ..... 368/337, 341, 340, 338, 368/336; 138/38, 42

[56] References Cited

U.S. PATENT DOCUMENTS

| | | | |
|---|---|---|---|
| 1,496,896 | 6/1924 | Laffoon | 366/337 |
| 3,414,164 | 12/1968 | McKay | 366/337 |
| 3,423,076 | 1/1969 | Jacobs et al. | 366/337 |
| 4,207,009 | 6/1980 | Glocker | 360/337 |

FOREIGN PATENT DOCUMENTS

| | | | |
|---|---|---|---|
| 1387695 | 3/1975 | United Kingdom | 366/252 |

*Primary Examiner*—Frankie L. Stinson

[57] ABSTRACT

A plate blender for use in the blending of particulate and granular solid materials is disclosed. The plate blender includes a tank having a plurality of vertical, radially extending baffles and with a series of vertically spaced windows in some of the baffles. In one embodiment, one of the baffles is of solid construction and the remaining baffles have a series of vertically spaced windows in each baffle, with the series of windows for each successive baffle in the direction of filling of the vessel being located at a progressively lower level than for the previous baffle so that the filling sequence results in the material to be blended being allowed to flow successively from one blending zone to the next around the circumference of the vessel and with the location and number of windows providing for consecutive layers of material throughout the zones. The plate blender may be employed in the blending of flowable particulate solid materials such as plastic pellets and powders. The plate blender of the present invention is less expensive and easier to fabricate than previous designs and provides for easy cleaning.

11 Claims, 2 Drawing Sheets

FIG. 4
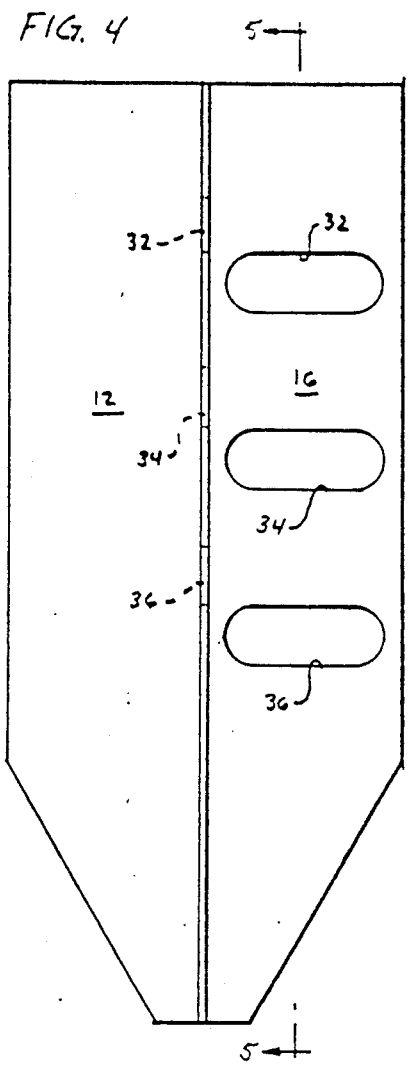
FIG 5
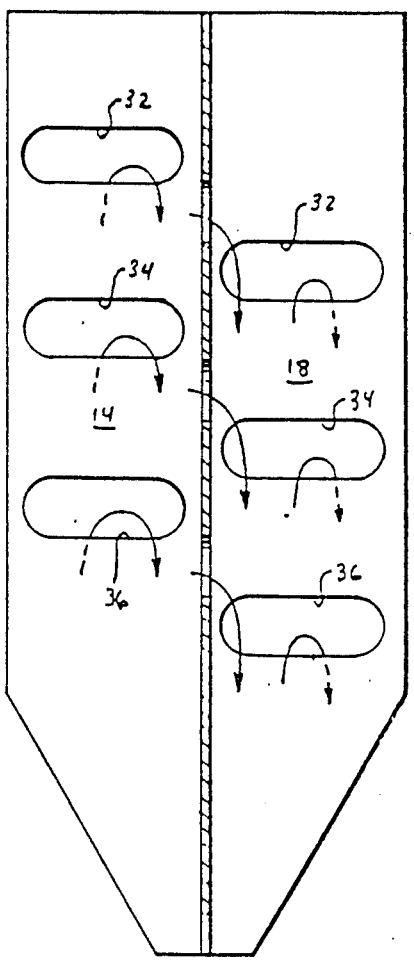
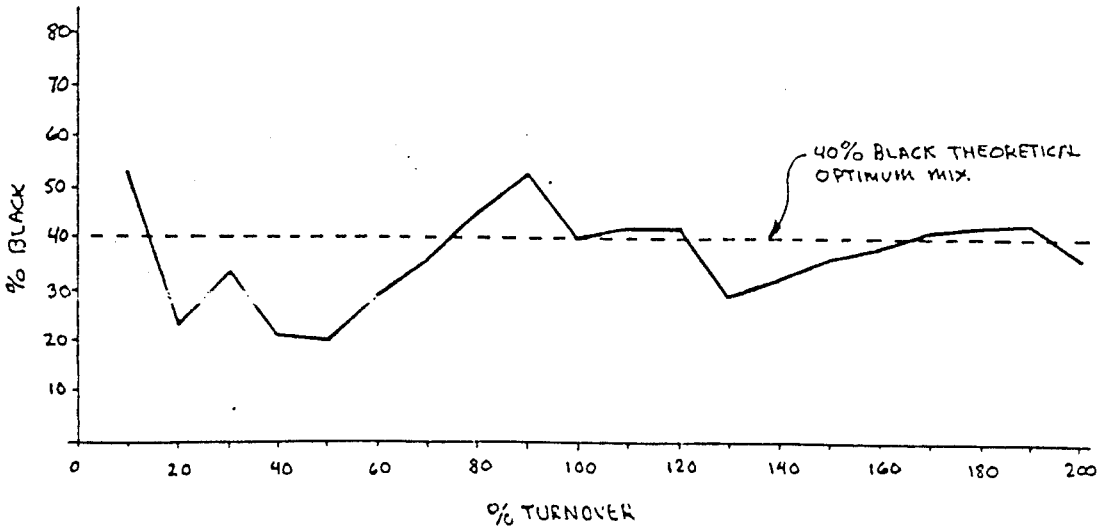
FIG. 6

PLATE BLENDER

BACKGROUND AND SUMMARY OF THE INVENTION

The present invention relates to a plate blender for use in the blending of particulate and granular solid materials. More particularly, the present invention relates to a plate blender which in one embodiment includes a cylindrical tank having a plurality of vertical, radially extending baffles installed therein, and with a series of vertically spaced windows in at least some of the baffles. The plate blender of the present invention may be advantageously employed in the blending of flowable particulate solid materials such as plastic pellets and powders.

Previous blending apparatus for the blending of various types of grains and powders are described, for example, in the following U.S. Pat. Nos.: 2,270,847 to Hyman; 2,455,572 to Evans; 3,145,975 to Towns; 3,275,303 to Goins; 3,423,076 to Jacobs et al.; 4,207,009 to Glocker; and 4,412,748 to Wohnhas et al.

By the present invention, there is provided an improved mixing and blending apparatus for particulate material in which a plurality of window openings are positioned in vertical, radially extending baffles to create a gravity flow sequence which will provide a blended material at the outlet. The window arrangement and spacing is determined from the material inlet conditions which define the time/volume relationship for the parameters to be blended. This window/baffle arrangement results in the material to be blended being allowed to flow successively from one blending zone to the next around the circumference of the vessel and with the location and number of windows providing for consecutive layers of material throughout the zones.

BRIEF DESCRIPTION OF THE DRAWINGS

FIG. 4 is an elevation of the baffles employed in the plate blender of FIG. 1.

FIG. 5 is a cross sectional view taken along line 5—5 of FIG. 4.

FIG. 6 is a graph showing the results of a performance test employing the plate blender of FIG. 1.

DESCRIPTION OF THE PREFERRED EMBODIMENTS

Figure 1:
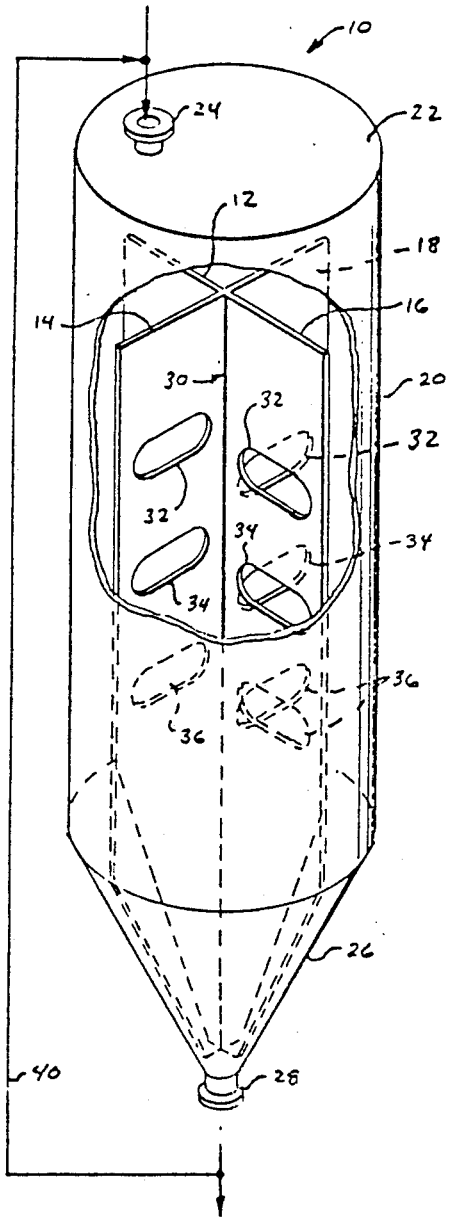
FIG. 1 is a perspective view of a plate blender constructed in accordance with the present invention.

In the illustrated embodiment of the present invention as shown in FIGS. 1 through 6, there is provided a plate blender 10 in the form of a cylindrical tank or shell 20 having a top closure 22 with an access opening 24 and a conical bottom 26 provided with an outlet 28. A plurality of vertical, radially extending baffles 12, 14, 16, 18 are mounted so as to intersect along a common line of intersection 30 which is coaxial with the longitudinal axis of the tank 20. As shown in FIG. 1, the baffles 12, 14, 16, 18 extend outwardly to the walls of the tank 20 and downwardly to a point just above the outlet 28.

In one embodiment of the invention, one baffle 12 is of solid construction. The remaining baffles 14, 16, 18 are provided with a series of vertically spaced windows 32, 34, 36 with such windows 32, 34, 36 being located so that, for each successive baffle in the direction of filling of the tank 20, the windows are located progressively lower than for the previous baffle in a descending or stair-step pattern, as hereinafter described. The adjacent baffles create filling zones 1 through 4 as shown in FIG. 2.

The windows 32, 34, 36 may be of any suitable shape which will provide an opening of sufficient size to prevent the particulate material from bridging. In one embodiment, as shown in FIGS. 1 through 5, the windows 32, 34, 36 were in the general shape of rectangles with rounded corners. Alternatively, the windows could be of circular shape, for example.

Figure 2:
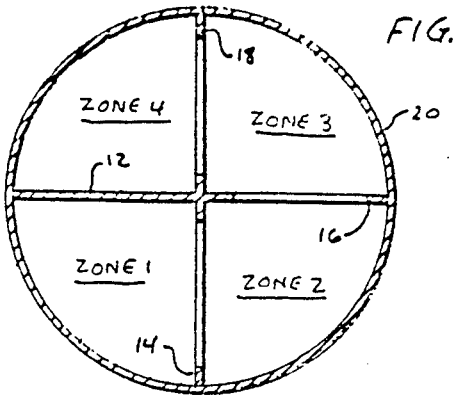
FIG. 2 is a cross sectional view of the plate blender of FIG. 1.
Figure 3:
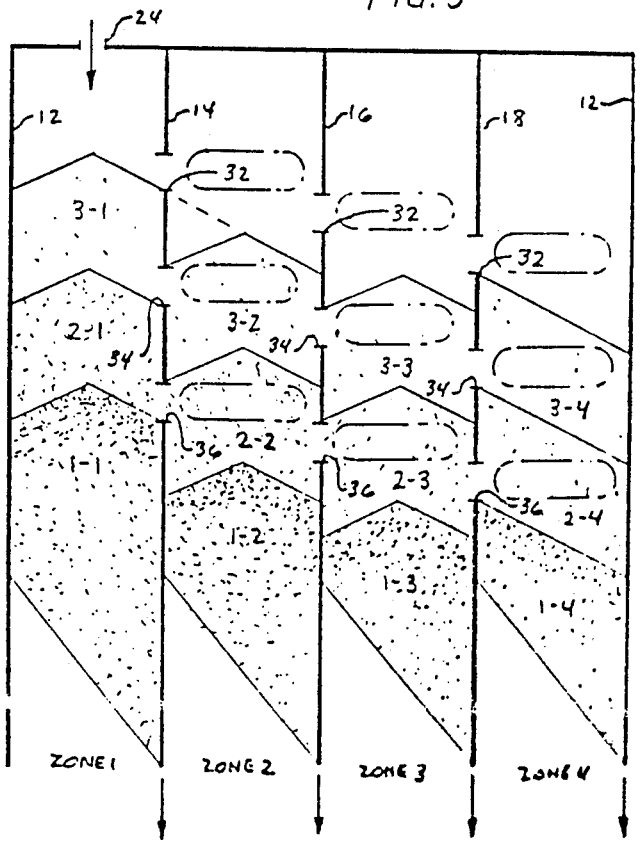
FIG. 3 is a schematic diagram of a filling sequence employing the plate blender of FIG. 1.

The access opening 24 in the top of the tank 20 is located above filling zone 1 created by solid baffle 12 and the adjacent windowed baffle 14, as shown in FIGS. 1 through 3. The top closure 22 may be of any suitable shape such as a flat planar surface or a hemispherical shape, depending on the vessel pressure requirements. The conical bottom 26 may be constructed with the angle of the cone being an angle such as 60 degrees. In one embodiment, the plate blender 10 was of a size such that the outside diameter of the tank 20 was about 10 feet and the overall height of the blender 10 was about 30 feet. In this embodiment, the windows 32,34, 36 had a width of about 4 feet and a height of about 1 foot 6 inches, and with a vertical interval of about 3 feet between adjacent windows on each individual baffle. The operating capacity of the tank 20 in this embodiment was approximately 1500 cubic feet.

The present invention operates as a static apparatus with gravity flow only and without rotation of the tank. The windows in each of the baffles 14, 16, 18 are constructed so that some filling will take place in each of the filling zones based on flow through each of the windows 32, 34, 36 in succession in the first windowed baffle 14 prior to filling occurring in zone 1 between windows 36 and 34. This is achieved by providing for window 36 in baffle 16 to be lower than window 36 in baffle 14 and, similarly, for window 36 in baffle 18 to be lower than window 36 in baffle 16. In order to obtain the desired filling sequence shown in FIG. 3, windows 34 in baffles 16 and 18 should also be successively lower than window 34 in baffle 14, but window 34 in baffle 18 should be higher or above the level of window 36 in baffle 14. The upper windows 32 for baffles 14, 16 and 18 should be located in a similar pattern with respect to each other as well as window 34 in baffle 14. The filling sequence which results from the windows being located in a descending or stair step arrangement for successive baffles is shown by the arrows in FIG. 5.

With the windows arranged as described above, the following fill sequence is obtained as flowable particulate material passes into zone 1 through top opening 24 in the tank 20, with reference to FIG. 3:

FILL SEQUENCE

1-1→1-2→1-3→1-4→2-1→2-2→2-3→2-4→3-1→3-2→3-3→3-4

Upon completion of the fill sequence, the material may be recirculated by allowing the material to pass out of the outlet 28 and back through feed line 40 to the top opening 24 for a second fill sequence.

The following examples are intended to provide illustrative embodiments of the invention without limiting the scope thereof.

EXAMPLE 1

A test was carried out to evaluate the performance of the plate blender of the present invention as shown in FIG. 1 by loading a 1:10 scale model of the blender with polycarbonate pellets of two different colors. The blender model was first loaded with single color plastic pellets to full volume. A total of ten fill container loads were needed to fill the blender.

This procedure was done to determine the actual capacity of the blender. The blender was then emptied. The blender was refilled with 20 percent black, 60 percent white and 20 percent black pellets (one fill container represents 10 percent of blender volume).

The pellets were discharged into a reloading mechanism placed at the outlet 28 of the blender and a sample was taken for every 10 percent of blender volume turnover. Discharged pellets were loaded back into the blender through the top opening 24 after each sample. The reloading mechanism was configured to achieve a "first out/first in" pellet return so that this mechanism did not contribute to the blending. In one embodiment, this was accomplished by the use of a cylindrical vessel with entry of pellets at the top of the vessel and exit of pellets from the bottom of the vessel. A total of 20 samples were taken to complete a 200 percent turnover. The black and white pellets of each sample were separated, counted and recorded. It was determined that the useable volume of the blender is approximately 30 percent less than the total vessel volume, based on the test procedure from step one. This is attributed to the plate baffle and window arrangement used in this configuration. Other arrangements were tried to increase the useable volume, however the useable volume increase was at the expense of blending performance.

Table I shows the black and white counts for every 10 percent of blender volume turnover. From this data, the percent of black pellets was calculated and tabulated.

TABLE I

| Sample No. | % Turnover | No. Black | No. White | % Black |
|---|---|---|---|---|
| 1 | 10 | 234 | 220 | 52 |
| 2 | 20 | 156 | 519 | 23 |
| 3 | 30 | 202 | 406 | 33 |
| 4 | 40 | 133 | 511 | 21 |
| 5 | 50 | 108 | 420 | 20 |
| 6 | 60 | 319 | 773 | 29 |
| 7 | 70 | 137 | 239 | 36 |
| 8 | 80 | 219 | 264 | 45 |
| 9 | 90 | 116 | 106 | 52 |
| 10 | 100 | 458 | 692 | 40 |
| 11 | 110 | 230 | 321 | 42 |
| 12 | 120 | 182 | 247 | 42 |
| 13 | 130 | 134 | 327 | 29 |
| 14 | 140 | 178 | 371 | 32 |
| 15 | 150 | 158 | 278 | 36 |
| 16 | 160 | 315 | 505 | 38 |
| 17 | 170 | 287 | 410 | 41 |
| 18 | 180 | 230 | 321 | 42 |
| 19 | 190 | 313 | 417 | 43 |
| 20 | 200 | 362 | 644 | 36 |

FIG. 6 shows a graph of percent turnover versus percent black counts taken from Table I. It was found that by recirculating the blended pellets (110 percent to 200 percent turnover) the blend performance improved significantly. The percent black counts rapidly approached the 40 percent black theoretical mix as shown by the broken line.

EXAMPLE 2

In a second test, a plate blender similar to that of Example 1 but with one window in each baffle was employed. The windows were at a height of approximately mid-volume of the blender and the same stair-step window pattern for successive baffles was employed. The input was 20 percent black - 20 percent blue - 20 percent black -20 percent blue - 20 percent black, rather than the 20 percent - 60 percent - 20 percent input of Example 1.

Table II shows the amounts by volume for the respective colored pellets. From this data, the percent of black pellets was calculated. As shown in Table II, blending improved considerably during the second turnover.

TABLE II

| Sample No. | % Turnover | ml Black | ml Blue | ml Total | % Black |
|---|---|---|---|---|---|
| 1 | 10 | 4.0 | 14.0 | 18.0 | 22.2 |
| 2 | 20 | 8.0 | 13.0 | 21.0 | 38.1 |
| 3 | 30 | 5.0 | 12.0 | 17.0 | 29.4 |
| 4 | 40 | 6.0 | 8.0 | 14.0 | 42.9 |
| 5 | 50 | 6.5 | 11.0 | 17.5 | 37.1 |
| 6 | 60 | 5.6 | 8.4 | 14.0 | 40.0 |
| 7 | 70 | 6.5 | 8.0 | 14.5 | 44.8 |
| 8 | 80 | 6.7 | 9.8 | 16.5 | 40.6 |
| 9 | 90 | 6.2 | 8.4 | 14.6 | 42.5 |
| 10 | 100 | 6.0 | 8.5 | 14.5 | 41.4 |
| 11 | 110 | 5.4 | 9.0 | 14.4 | 37.5 |
| 12 | 120 | 6.0 | 9.6 | 15.6 | 38.5 |
| 13 | 130 | 7.0 | 8.4 | 15.4 | 45.5 |
| 14 | 140 | 6.4 | 8.5 | 14.9 | 43.0 |
| 15 | 150 | 6.2 | 9.5 | 15.7 | 39.5 |
| 16 | 160 | 6.0 | 9.0 | 15.0 | 40.0 |
| 17 | 170 | 6.2 | 8.0 | 14.2 | 43.7 |
| 18 | 180 | 6.2 | 8.6 | 14.8 | 41.9 |
| 19 | 190 | 7.0 | 9.8 | 16.8 | 41.7 |
| 20 | 200 | 6.0 | 9.5 | 15.5 | 38.7 |

The plate blender of the present invention has been found to be highly useful as it will blend product as well as or better than competitive designs. The present plate blender is also less expensive to fabricate than previous devices of this type, with many prior art blending vessels requiring relatively complex internal tubes and support apparatus which add considerable cost and complexity. The plate blender of the present invention provides for easy cleaning, whereas previous devices have numerous interior locations where product can collect which often results in product contamination. This feature is particularly important in applications where numerous products or product colors are run through the same blender.

Additional advantages of the plate blender of the present invention include the fact that the blender is easy to adapt to any existing storage or blending vessel by simply stripping out the internal construction of the existing vessel and installing blending baffles in accordance with the present invention. The blender of the present invention requires only a single conveying line, which may be of pneumatic type, for recirculation of product, whereas blending devices of the prior art generally require larger and more complex support equipment. The plate blender of the present invention has no moving parts and is extremely simple to operate. In this regard, the inlet and outlet lines and valves as well as feed and recirculation lines may be operated either manually or automatically by any of various conventional control systems.

Any number of baffles can be used to create the desired number of zones within the blending vessel of the present invention. The use of a greater number of zones will improve blending but will also reduce cleanability, increase cost and reduce the usable blending volume of the containment vessel.

It has been found that the configuration of the baffle windows is dependent on the characteristics of the product being handled. Thus various window shapes and spacings may be employed to optimize performance with plastic pellets or other granular materials. The plate blender of the present invention may be advantageously employed in the bulk materials-handling industry.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. A stationary mixing and blending apparatus for particulate material which employs a static action for solids mixing on a batch flow basis comprising: a chamber having walls and an inlet and outlet at substantially opposite ends thereof; a plurality of planar baffle members positioned within said chamber and extending radially outwardly to and contacting the chamber walls, said baffle members defining a plurality of vertically extending blending zones with one blending zone located between each two adjacent baffle members, said baffle members each having at lest one opening or window for passage of said particulate material from one blending zone to another; and with said inlet for the chamber being positioned above a blending zone defined between adjacent baffles, wherein the opening for each successive baffle in one of either a clockwise or counter clockwise direction from an upper opening is at a progressively lower level around the circumference of the chamber.

2. The apparatus of claim 1 further including an additional baffle member having a solid wall construction.

3. The apparatus of claim 1 wherein said baffle members extend radially outwardly from a central point of attachment, and wherein said point of attachment of said baffle members is linear and coincides with the vertical axis of said chamber.

4. The apparatus of claim 1 wherein each of said baffle members has a series of vertically spaced openings for passage of particulate material from one blending zone to another.

5. The apparatus of claim 4 wherein each baffle having openings therein has the opening so located that the corresponding opening cause a vertical drop of particles entering the vessel so that particles at the same level in the filled vessel zones enter the vessel at different times.

6. The apparatus of claim 4 wherein the series of openings for each successive baffle in the direction of filling of the chamber is located at a progressively lower level than for the previous baffle so that the filling sequence results in the material to be blended being allowed to flow successively from one blending zone to the next around the circumference of the chamber and with the location and number of openings providing for consecutive layers of material throughout the zones.

7. The apparatus of claim 4 wherein each baffle having openings has the same number of openings in a vertically descending pattern for each opening in the series.

8. The apparatus of claim 4 wherein a total of four baffles are employed at equally spaced intervals so that each baffle forms an angle of about 90 degrees with each adjacent baffle.

9. The apparatus of claim 4 wherein each baffle having openings therein has the openings so located that each opening is at a different horizontal level than the opening in any other baffle so that there is no overlap in a horizontal direction between the space occupied by any of the openings.

10. The apparatus of claim 1 wherein said chamber is of cylindrical form with a conically extending lower end portion.

11. The apparatus of claim 1 wherein said openings have the general shape of a rectangle with rounded corners.

* * * * *